United States Patent [19]

Grimm et al.

[11] Patent Number: 4,843,858

[45] Date of Patent: Jul. 4, 1989

[54] TUBE BENDING APPARATUS

[75] Inventors: Michael N. Grimm, Roanoke; Forrest F. Farley, Jr., New Castle; Randolph C. Oliver, Newport, all of Va.

[73] Assignee: Crawford Fitting Company, Solon, Ohio

[21] Appl. No.: 74,989

[22] Filed: Jul. 16, 1987

[51] Int. Cl.[4] ..... B21D 7/04

[52] U.S. Cl. ..... 72/149

[58] Field of Search ..... 72/149, 151–153, 72/156–159, 217, 218, 219, 319, 320, 321

[56] References Cited

U.S. PATENT DOCUMENTS

| | | | |
|---|---|---|---|
| Re. 814 | 9/1859 | Perkins et al. | 72/142 X |
| 643,760 | 2/1900 | Brinkman . | |
| 682,671 | 9/1901 | Condon | 72/159 X |
| 1,133,401 | 3/1915 | Redding . | |
| 1,216,229 | 4/1918 | Hansen . | |
| 1,848,753 | 3/1932 | Spate et al. | 72/154 |
| 2,223,015 | 5/1937 | Hawthorn . | |
| 2,306,221 | 11/1942 | Parker et al. . | |
| 2,306,224 | 11/1942 | Parker et al. . | |
| 2,488,896 | 11/1949 | Bertolini et al. | 72/159 X |
| 2,695,538 | 11/1954 | Parker . | |
| 2,702,065 | 2/1955 | Franck . | |
| 2,777,500 | 1/1957 | Ekholm et al. | 72/150 X |
| 2,903,039 | 9/1959 | Raynes . | |
| 2,938,565 | 5/1960 | Klamm . | |
| 2,986,195 | 5/1961 | Landis | 72/157 X |
| 3,416,345 | 12/1968 | Stanley . | |
| 3,584,492 | 6/1971 | Dodge et al. . | |
| 3,729,975 | 5/1973 | Del Monica . | |
| 3,785,190 | 1/1974 | Schall et al. | 72/149 |
| 4,052,878 | 10/1977 | Connelly . | |
| 4,236,398 | 12/1980 | Schwarze et al. | 72/157 |
| 4,249,407 | 2/1981 | Fogelman | 72/159 X |

FOREIGN PATENT DOCUMENTS

| | | | |
|---|---|---|---|
| 725744 | 4/1980 | U.S.S.R. | 72/149 |

OTHER PUBLICATIONS

Federal Specification, Bender, Tube, Hand (Portable), Interim Amendment, 1963.

*Primary Examiner*—E. Michael Combs

*Attorney, Agent, or Firm*—Fay, Sharpe, Beall, Fagan, Minnich & McKee

[57] ABSTRACT

A tube bending apparatus of the radius block and slide block type is provided with a one-way drive means for permitting selectable driven rotation of the radius block means thereof in the bending direction while preventing reverse driving. Interchangeable radius block and slide block means are provided to accommodate different size bend radii and tube diameter to be accommodated. The apparatus also includes slide block retainer means for accommodating different height slide blocks, as well as tube clamping means for accommodating different tube diameters. The slide block means may be marked with indicia for aiding in the gauging of center-to-center dimensional gain in finished 45 and 90 degree forward and reverse bends prior to forming the bends. A method for pre-gauging center-to-center dimensional gain of such bends is also described. A second embodiment of the tube bending apparatus includes radius block and slide block means having inclined concavities for forming radiused overlapping 360 degree bends.

9 Claims, 7 Drawing Sheets

FIG. 10
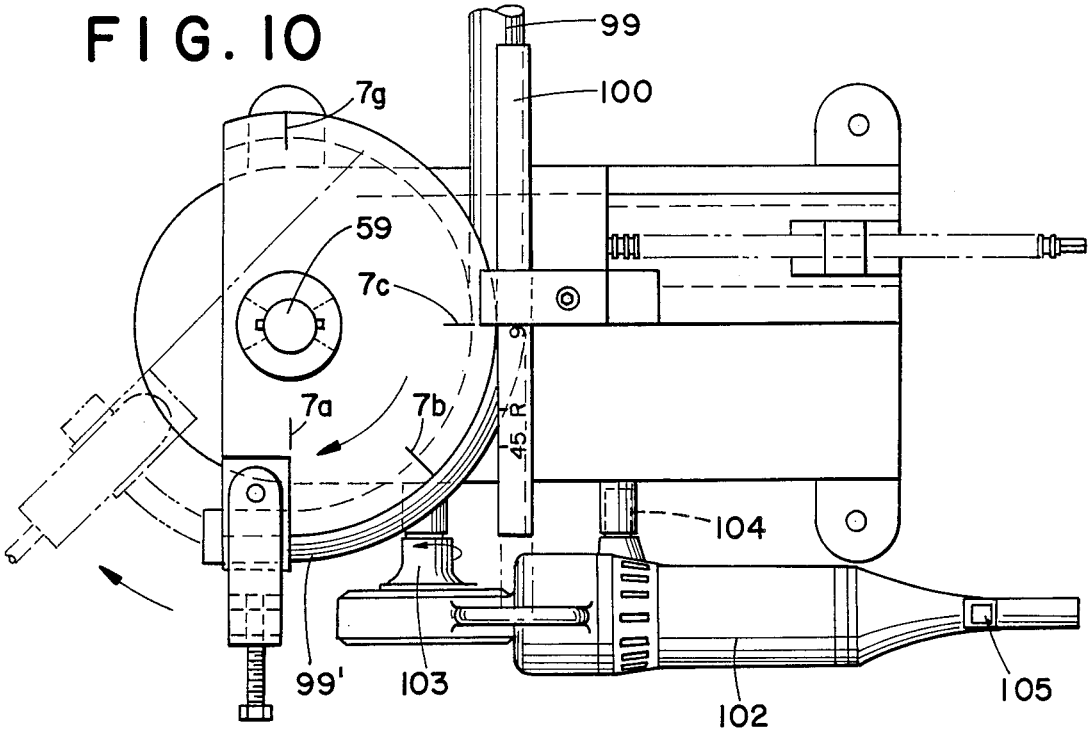
FIG. 14A
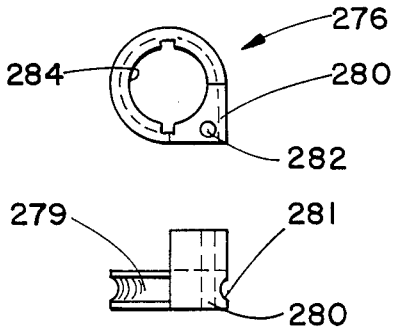
FIG. 14B
FIG. 15A
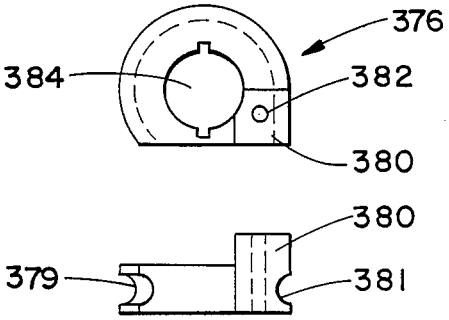
FIG. 15B
FIG. 16
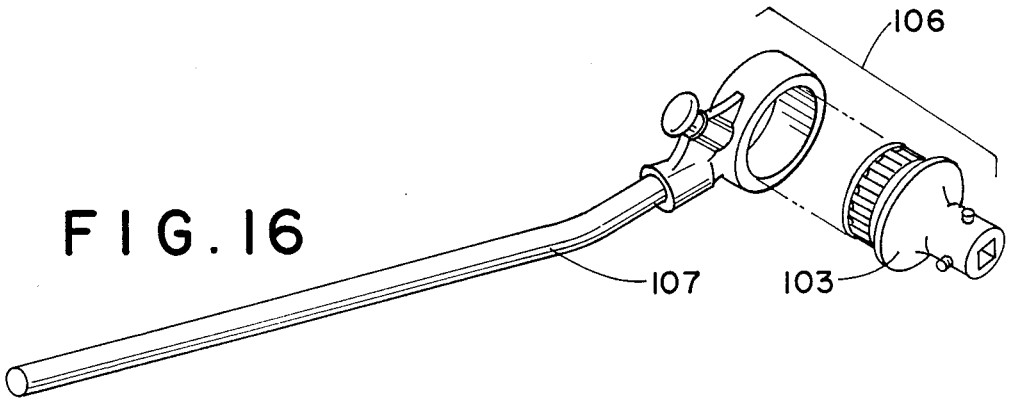

FIG. 17
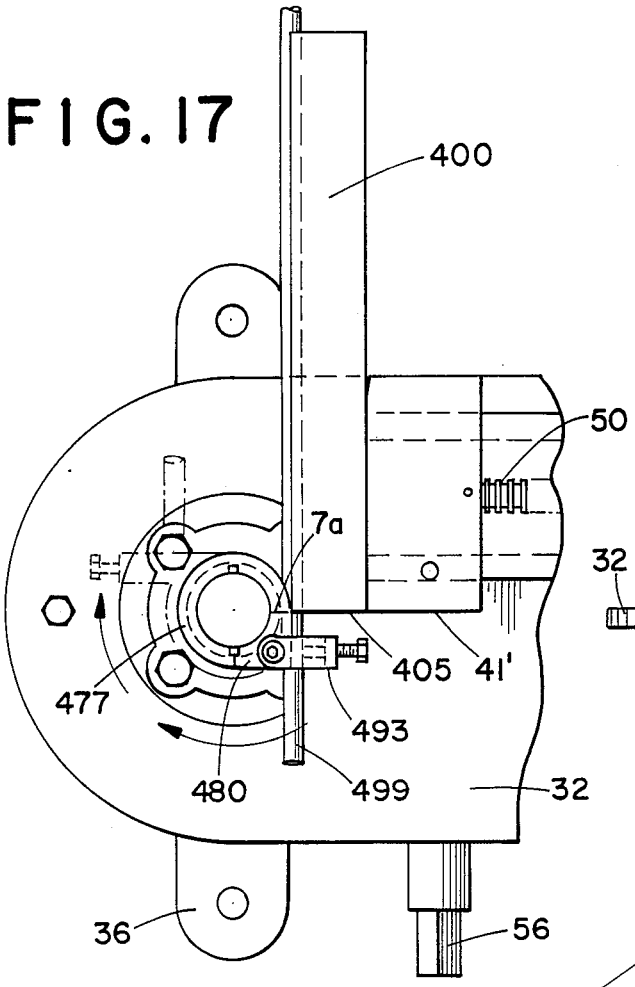
FIG. 18
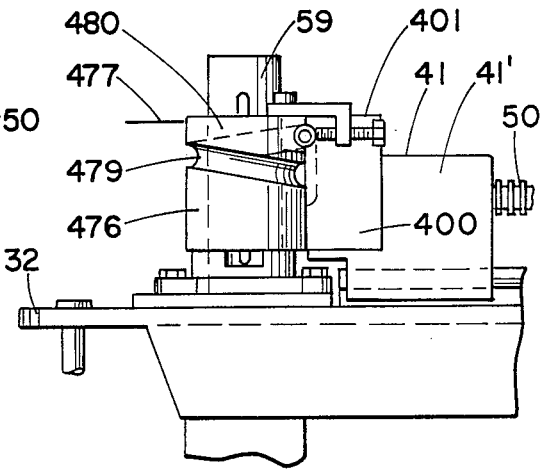
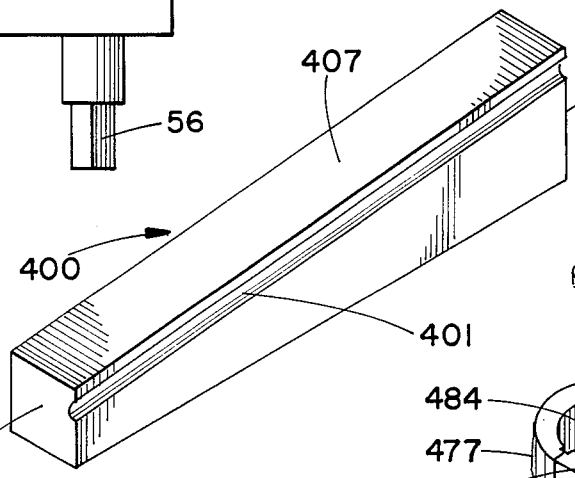
FIG. 19
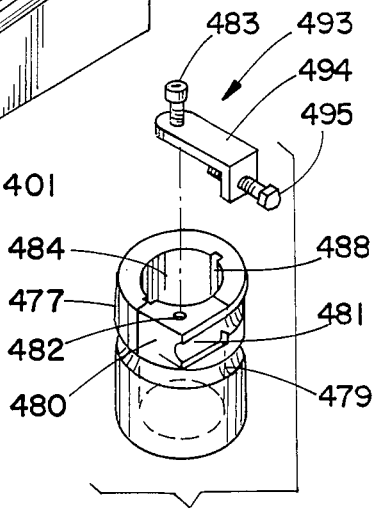
FIG. 20
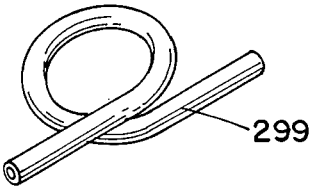
FIG. 21

TUBE BENDING APPARATUS

BACKGROUND AND SUMMARY OF THE INVENTION

This invention relates to an apparatus and method for forming arcuate bends in round section metal tubing.

Round section metal tubing is manufactured from various materials and alloys in a variety of standardized sizes of nominal outside diameter and wall thickness, and is, generally, sold in straight lengths. Such tubing is widely used in many industries and trades, and, often, the terms "tube" and "pipe" are interchangeably used. While sections of tubing are available with preformed bends, such as "elbow sections" having a 90 degree bend, such preformed sections are expensive compared to straight sections and, additionally, such preformed bends as sold, are usually of a limited length. Therefore, preformed bends, typically, are joined to straight sections of tubing, which adds to the assembly costs. Thus, the need for a way to form bends in straight sections of round metal tubing has given rise to various types of apparatus. For example, such apparatus are often used in the manufacture of the preformed bend sections referred to above.

Due to the nature of the available types of round section-metal tubing, bends must typically be formed along a minimum inside bend-radius in order to avoid crimping the tubing. Furthermore, engineering practices prescribe minimum bend radii in order to assure the maintenance of adequate tube wall thickness and strength. Minimum radiuses are prescribed because the bending operation causes thinning by stretching the tube wall at the outer side of the bend and also by setting up compressive stresses in the tube wall at the inner side of the bend.

Various approaches have been taken in the art to avoid crimping the tube during bending, including the use of mandrel type devices placed inside the tube for supporting the tube wall. Examples of the use of mandrel devices for tube bending apparatus are found in U.S. Pat. Nos. 986,654 to Tattu, 1,007,834 to Wilson and 1,600,339 to Klarwasser. However, the use of mandrels is often impractical, and undesirably adds complexity to the bending operation, especially where a bend is to be formed at a distance from the open ends of a tube.

In order to assure a uniform minimum bending-radius, there have been employed various types of components known as "radius blocks", "bending shoes", and "bending dies". All of these components are generally characterized by having a curved, hemispherical, or semicircular section-die concavity formed therein along a desired radius, where the concavity of the die's cross-section conforms to the outer diameter of the tube to be bent. By various means, the tube is forced to engage and follow the concavity in the radius block's bending die along its curvature, in which way the tube is caused to be formed with the desired bend radius. Typically, such radius blocks may be mounted for rotation about an axis, which axis thus becomes the centerline of the bend radius. In such a typical apparatus, the tube to be bent may be held in place against the concavity of the radius block's curved die at the beginning or starting location of the bend by means of a clamping device, so that as the radius block is caused to rotate about its axis, the tube, being clamped to the radius block, is forced into the curved concavity of the radiused die. In order to assure that the tube is fed into the curved concavity of the radius block die as the radius block is rotated about its axis, and also in order to prevent undesirable bulging or narrowing of the tube cross-section at the bend location, known apparatus also typically employ a component known variously as a "slide block", "follow block", "backing block" or "backing die" which is formed with a hemispherical or semicircular section concavity therein conforming to the tubing outside diameter in the manner of the radius block's bending die, but such slide blocks are straight rather than curved and the concavity therein is also straight. Such slide blocks are typically movable longitudinally along their axis of concavity, i.e., in a direction parallel to the straight axis of the tubing. In this manner, the slide block is made to lie snugly against the outside portion of the tube in opposition to the curved radius block die, with the outside portion of the tube being thus engaged within the concavity of the slide block. Then, as the radius block, having the starting tube section clamped thereto, is rotated about its axis, the tube's straight following inside portion is "pulled" or drawn by its clamped straight starting section into engagement with the curved following concavity of the radius block die causing a bend to be started in the tube, while the tube's corresponding opposing following outside portion, which had been previously engaged within the straight concavity of the slide block is caused to be drawn inwardly toward the radius block's curved die and away from and out of engagement with the straight concavity of the slide block. At the same time, because of the snug fit between the outer tube portion and the concavity of the movable slide block, the slide block is drawn forward by the tube as the tube is drawn onto the radius block's bending die, causing the slide block to move tangentially in relation to the curvature of the radius bend being formed in the tubing. As the radius block is rotated further, the following straight inside portions of the tube are continuously and successively drawn into engagement with the corresponding following portions of the curved concavity of the radius block's bending die while the corresponding following outside portions of the tube are correspondingly continuously and successively drawn away from and out of engagement with the opposing straight concavity of the slide block. In this way, as long as the radius of curvature of the radius block's bending die concavity is not below the minimum bend radius, then the round cross-section of the tubing can be substantially maintained during the bending operation and crimping of the tubing avoided.

In the operation of such a typical apparatus, tube bending is thus performed by rotating the radius block the desired number of degrees to produce a bend of a corresponding number of degrees.

Exemplifying typical apparatus for forming radiused tubing bends in this manner are U.S. Pat. Nos. 986,654 to Tattu, 1,007,834 to Wilson, and 3,546,917 to Paine.

Other conventional tube bending apparatus are disclosed by U.S. Pat. Nos. 118,847 to Doe, 1,662,131 to Schonfield, 2,782,832 to Shaw, Jr. and 4,537,052 to Adelman.

Another typical tube bending apparatus in commercial use which employs a rotatable radius block and an opposing movable slide block is the Model HB832A tube bender manufactured by the Lakeland Products division of Teledyne Republic of Cleveland, Ohio. In this apparatus, interchangeable radius, clamp and slide blocks allow tubing of various diameters to be bent. The radius block around which the tube is bent is driven by a roller chain and sprocket, which rotates the center post and drive plate upon which the radius block is mounted. The roller chain is secured at its one end to the piston rod of a hydraulic cylinder, and thus hydraulic pressure is utilized in this apparatus to move the roller chain, which, being wrapped around the center post's sprocket, translates the linear motion of the piston into rotary motion of the sprocket and center post thus rotating the drive plate and radius block.

However, this reliance upon hydraulic power is disadvantageous in that a cumbersome external source of hydraulic power such as an electrically powered pump is required, which must be disconnected from and reconnected to the bender unit every time the unit is moved to a new site. Still further, this reliance upon hydraulic power gives rise to the serious possibility of a tube being bent becoming contaminated with hydraulic fluid due to leaking seals and couplings, burst hoses, spillage or carelessness. Such possibility of contamination can be hazardous where the tubing is to be used in or exposed to a nitric acid environment, due to the nitratability of commonly used hydraulic fluids, which can produce a crude form of explosive nitroglycerin. Cleanliness is also of prime concern in the food and drug industry.

A further drawback in the suitability of this apparatus results from its inability to perform bends in tubing having a wall thickness greater than 0.120 inch. Additionally, this apparatus suffers the shortcoming of being limited to effecting maximum bends of only 180 degrees. Also, because the roller chain is tensioned at its end opposite the hydraulic cylinder's piston by a spring in order to return the mechanism to a 0 degree starting position after a bend is completed, it is possible that the radius block's rotational direction may become reversed, as upon the sudden loss or releasing of hydraulic pressure, thus risking wrinkling or crimping of the tube.

Another problem encountered in the use of the conventional tube bending apparatus involves the complexity of gauging or laying out the center to center dimensions of finished bends. In particular, due to the radial deflection of the tube's centerline along the direction of the bend during the bending operation, it is difficult to accurately gauge the center to center dimensions of the finished bend. This "gain" is an inherent result of the bending process, yet the conventional tube bending machines make no provision for gauging the "gain" involved in forming a tubing bend. Rather, the conventional machines provide only sundry means for gauging the radius and degree sweep of a bend, and it is thus left to the artisan to gauge the center to center dimension of a finished bend. The need for accurate gauging becomes important when producing bend sections which must align precisely with a centerline, and when compound and reverse bends must be precisely formed in a tube.

In order to remedy the problems encountered in conventional tube benders, the present invention provides a tube bending apparatus of simple yet sturdy design incorporating significant design improvements, operational advantages and expanded capabilities over conventional designs. The present tube bending apparatus employs interchangeable rotatable radius block means to which a tube may be clamped with tube clamping means, and interchangeable slide block means for supporting a tube during bending. Adjustable slide block retaining means are provided for proper positioning of the slide block means. One-way drive means are provided for one-directional rotation of the radius block means during the bending operation in order to prevent reverse rotational driving of the radius block means for improved safety, and to permit driving of the apparatus by either portable electrically powered or manual driving means. Means are also provided for selectively disengaging the driveline to permit freewheeling of the radius block means. The one-way drive means is capable of drivingly rotating the radius block means an unlimited number of degrees in the bending direction. In a second embodiment of the present invention, novel radius block means and slide block means are provided for forming overlapping radiused 360 degree tube bends. Further, the present invention provides a method and means for accurately gauging the finished center to center dimensions of bends before commencing a bending operation, for facilitating the laying out of precise bends.

The present invention is directed to overcoming the above-mentioned limitations of the conventional tube bending machines by providing a portable tube bending apparatus which may be operated manually or with a widely used portable electrically driven power unit.

The present invention is further directed to overcoming the limitations of the conventional tube bending machines by providing a tube bending apparatus which is capable of forming radiused bends in thin, medium and thick walled round section metal tubing.

The present invention is still further directed to overcoming the limitations of the conventional tube bending machines by providing a method for forming radiused 360 degree bends, and by providing a tube bending apparatus which is capable of forming 360 degree radiused bends in round section metal tubing.

The present invention is further still directed to overcoming the limitations of the conventional tube bending machines by providing a tube bending apparatus having safety interlock means for preventing rotation of the radius block in the wrong direction.

The present invention is yet further directed to overcoming the limitations of the conventional tube bending methods and machines by providing a method for forming radiused bends having accurate center to center dimensions, and furthermore, by providing a tube bending apparatus including means for forming radiused bends with accurate center to center dimensions.

These and other objects and advantages of the present invention will be made clear from the following detailed description of the invention taken together with the drawing figures, in which like-numbered elements among the various figures correspond to one another.

BRIEF DESCRIPTION OF THE DRAWINGS

FIG. 10 is a top plan view showing the preferred embodiment of the tube bending apparatus of the present invention in power-driven operation forming a bend in a length of tubing.

FIGS. 14A and 14B are top and front views, respectively, showing a radius block means of the preferred embodiment of the present invention.

FIGS. 15A and 15B are top and front views, respectively, showing another radius block means of the present invention.

FIG. 16 is an exploded perspective view showing a manual operating means for the tube bending apparatus of the present invention.

FIG. 17 is a partial top plan view of a second embodiment of the tube bending apparatus of the present invention in a condition preparatory to commencing a 360 degree bending operation.

FIG. 18 is a partial front view of the embodiment shown in FIG. 17.

FIG. 19 is a perspective view showing a slide block means of the second embodiment of the tube bending apparatus of the present invention.

FIG. 20 is an exploded perspective view showing a radius block means of the second embodiment of the tube bending apparatus of the present invention.

FIG. 21 is a perspective view showing a length of tubing having a radiused overlapping 360 degree bend formed therein.

DETAILED DESCRIPTION OF THE INVENTION

Figure 1:
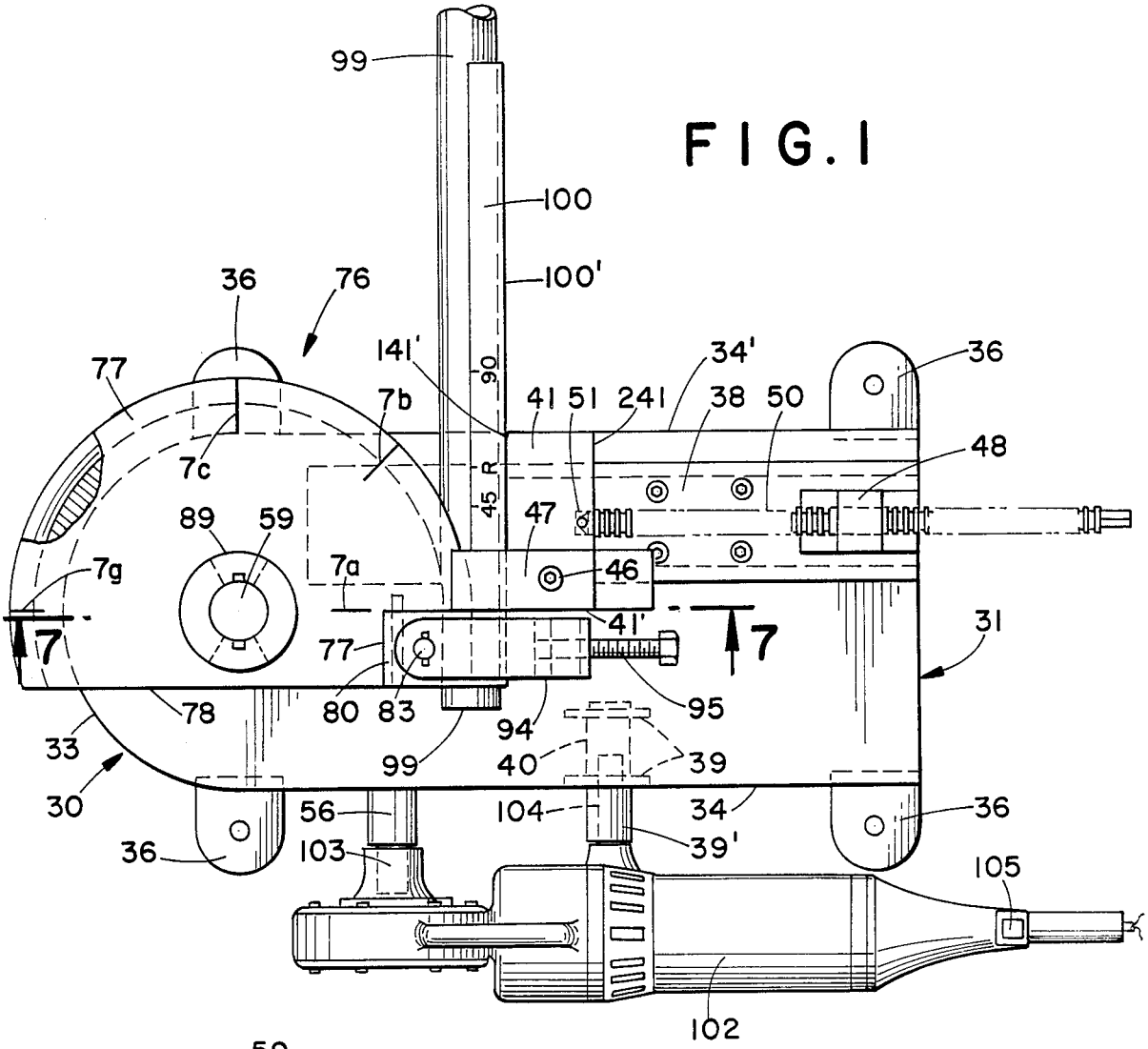
FIG. 1 is a top plan view of the preferred embodiment of the tube bending apparatus of the present invention with the portable power unit attached and in a condition ready for commencing a bending operation.
Figure 2:
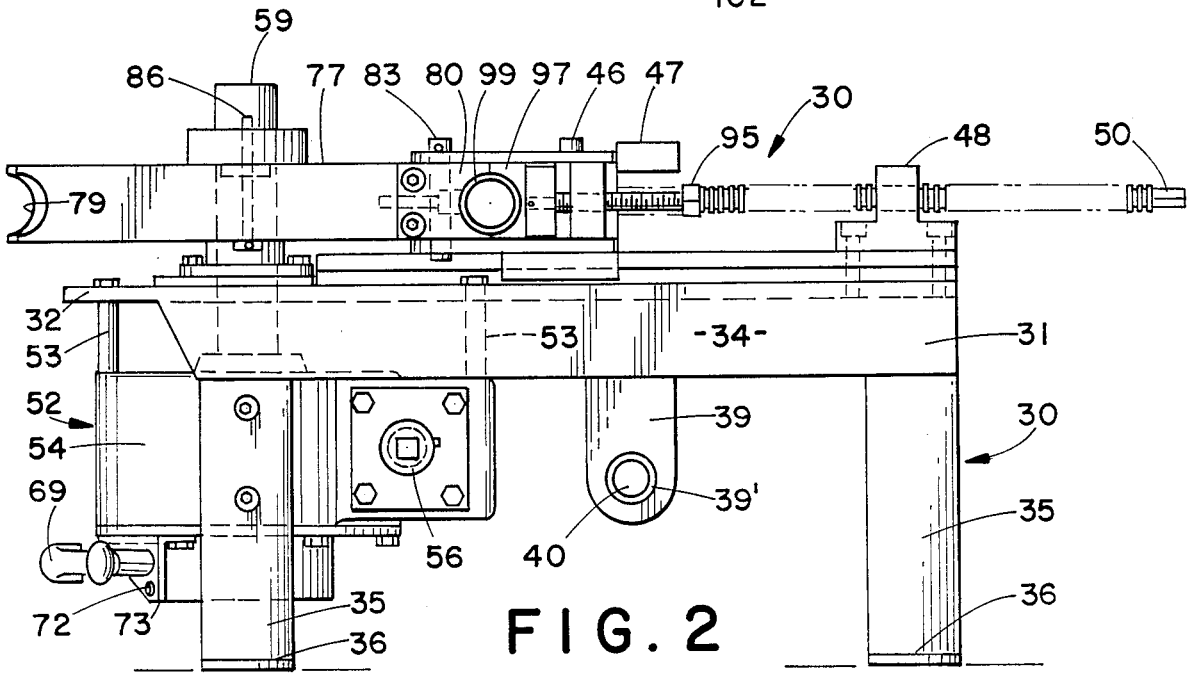
FIG. 2 is a front elevation view of the preferred embodiment of the tube bending apparatus of the present invention without the power unit for clarity and ready for commencing a bending operation.

Referring now to FIGS. 1 through 5, there is shown generally at 30 the tube bending apparatus of the present invention which includes a table means 31 having a generally rectangularly shaped top 32 with one rounded edge 33 at its short left end. At each of the long front and rear edges of top 32 there are respectively provided downwardly extended front and rear side rails 34 and 34'. Table means 31 is also provided with supporting legs 35 at the respective ends of both side rails 34 and 34', and each of the supporting legs 35 includes a foot pad 36. Foot pads 36 permit mounting table means 31 to a surface, or alternately may accommodate caster wheels, not shown, for rendering the apparatus mobile.

A rotary bearing 37 is mounted through the top 32 of table means 31. A vise rail 38 is mounted on the top 32 of table means 31 extending parallel with the rear side rail 34' thereof. Table means 31 also includes downwardly extending tab means 39 through which a short length of tubing 39' is mounted to provide a recess 40 opening towards the front of table means 31.

A vise block 41 is slidably mounted on vise rail 38 so as to be movable therealong between a stop 42 and an open end 43 of vise rail 38. Vise block 41 has a front face indicated at 41' which extends parallel with and faces toward the front side rail 34, and also a pair of side faces 141, 241 and top face 341. A horizontal shoulder 44 which extends outwardly toward edge 33 of table means 31 is provided on side face 141 of vise block 41. A threaded socket hole 45 is provided in top face 341 of vise block 41 into which a screw 46 may be threaded for securing a reversible slide block retainer plate 47 to top face 341 of vise block 41. When secured to vise block 41, slide block retainer plate 47 protrudes outwardly beyond side faces 141, 241 of vise block 41.

Figure 12:
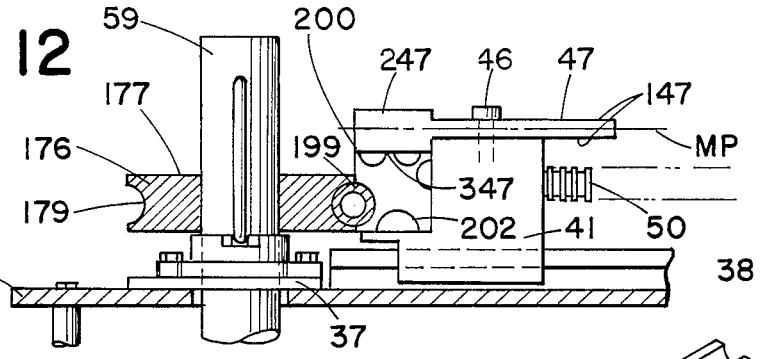
FIG. 12 is a partial sectional view taken along line 12—12 in FIG. 11.

Slide block retainer plate 47 (FIGS. 5 and 12) is formed at one end with top and bottom retaining surfaces 147 which are equidistantly spaced in horizontal planes from a medial plane MP as shown in FIG. 12. The opposite end of slide block retainer plate 47 is provided with top and bottom retaining surfaces 247 and 347 having different heights. In this way, by appropriately reversing the ends of retainer plate 47 and by turning retainer plate 47 over, a respective retainer surface 147, 247 or 347 may be positioned to protrude past side face 141 of vise block 41 to overlie shoulder 44.

A pillow block 48 is affixed to the vise rail 38 at a location proximate the end stop 42 thereof. Pillow block 48 has a threaded bore 49 for threadably receiving a vise screw 50 therethrough. One end of vise screw 50 is rotatably retained in a socket 51 formed in side face 241 of vise block 41 so that vise block 41 can be moved back and forth along vise rail 38 by rotation of vise screw 50. As described thus far, vise rail 38, vise block 41, shoulder 44, screw 46, slide block retainer plate 47, pillow block 48 and vise screw 50 together comprise the slide block retaining means of the first embodiment of the present invention, the operation of which will be more fully described below.

Figure 6:
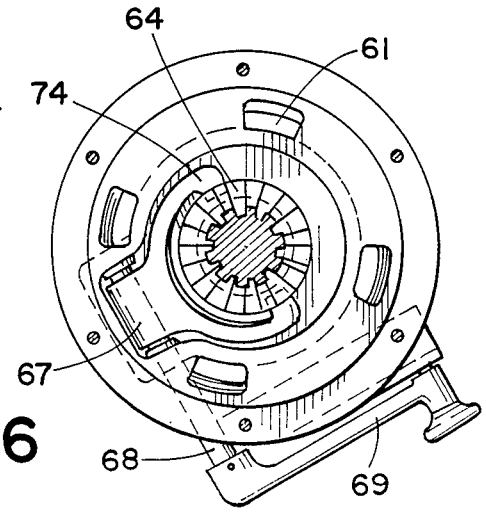
FIG. 6 is a sectional view taken along line 6—6 in FIG. 3.
Figure 7:
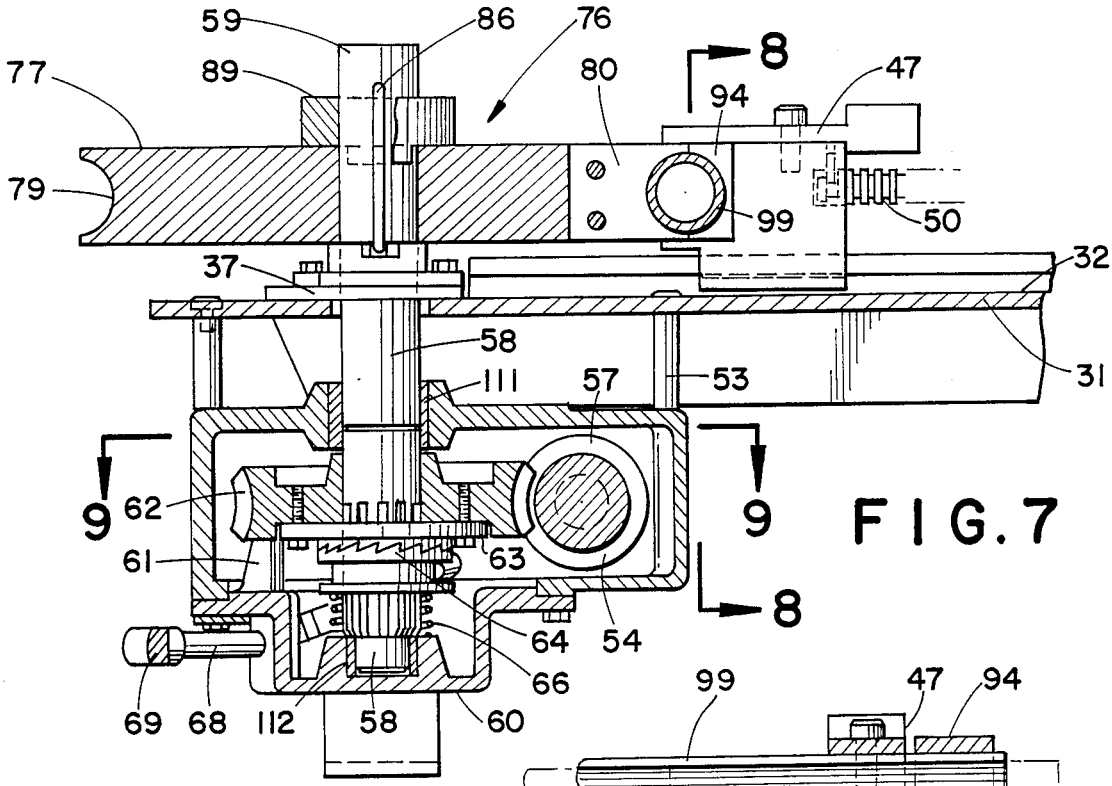
FIG. 7 is a sectional view taken along line 7—7 in FIG. 1.
Figure 8:
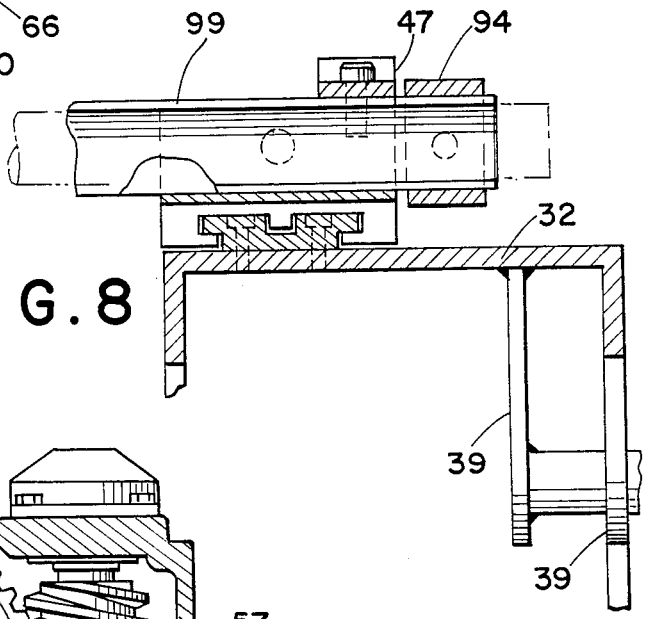
FIG. 8 is a partial sectional view taken along line 8—8 in FIG. 7.
Figure 9:
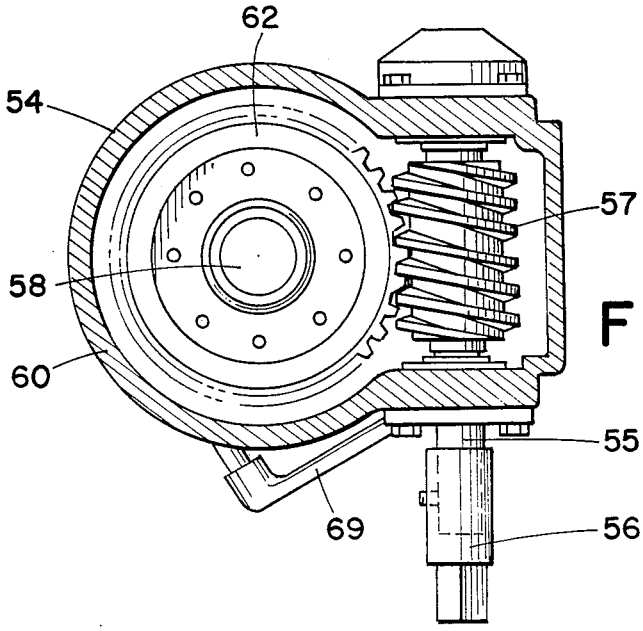
FIG. 9 is a sectional view taken along line 9—9 in FIG. 7.

Referring now also to FIGS. 6 through 9, the drive mechanism of the tube bending apparatus will be described. As shown more particularly in FIGS. 2 through 4, 5 and 7, a one-way drive assembly indicated generally at 52 is mounted to top 32 of table means 31 from below by spacers 53. One-way drive assembly 52 includes a main casing 54 in which is rotatably mounted an input worm shaft 55 (FIGS. 5 and 9) for receiving driving rotation from an external power source. To this end, the input end of input worm shaft 55 is provided with a square drive fitting 56 while the other end is provided with a driving worm gear 57 as best shown in FIG. 9. Worm shaft 55 is carried at its ends by bearings mounted to main casing 54. One-way drive assembly 52 also includes an output shaft 58 which extends through and is carried by bearing 37 in table means 31 so that an output end 59 of shaft 58 protrudes above top 32. The middle portion of shaft is carried by a bushing 111 mounted in main casing 54, while the lower end of shaft 58 is carried by a lower bushing 112 mounted to a gearbox lower casing 60 which in turn is bolted to main casing 54 as shown in FIG. 7. It should be noted that bearing 37 and one-way drive assembly 52 are mounted to table means 31 in such a location that the centerline of output shaft 58 is aligned with front face 41' of vise block 41.

Figure 5:
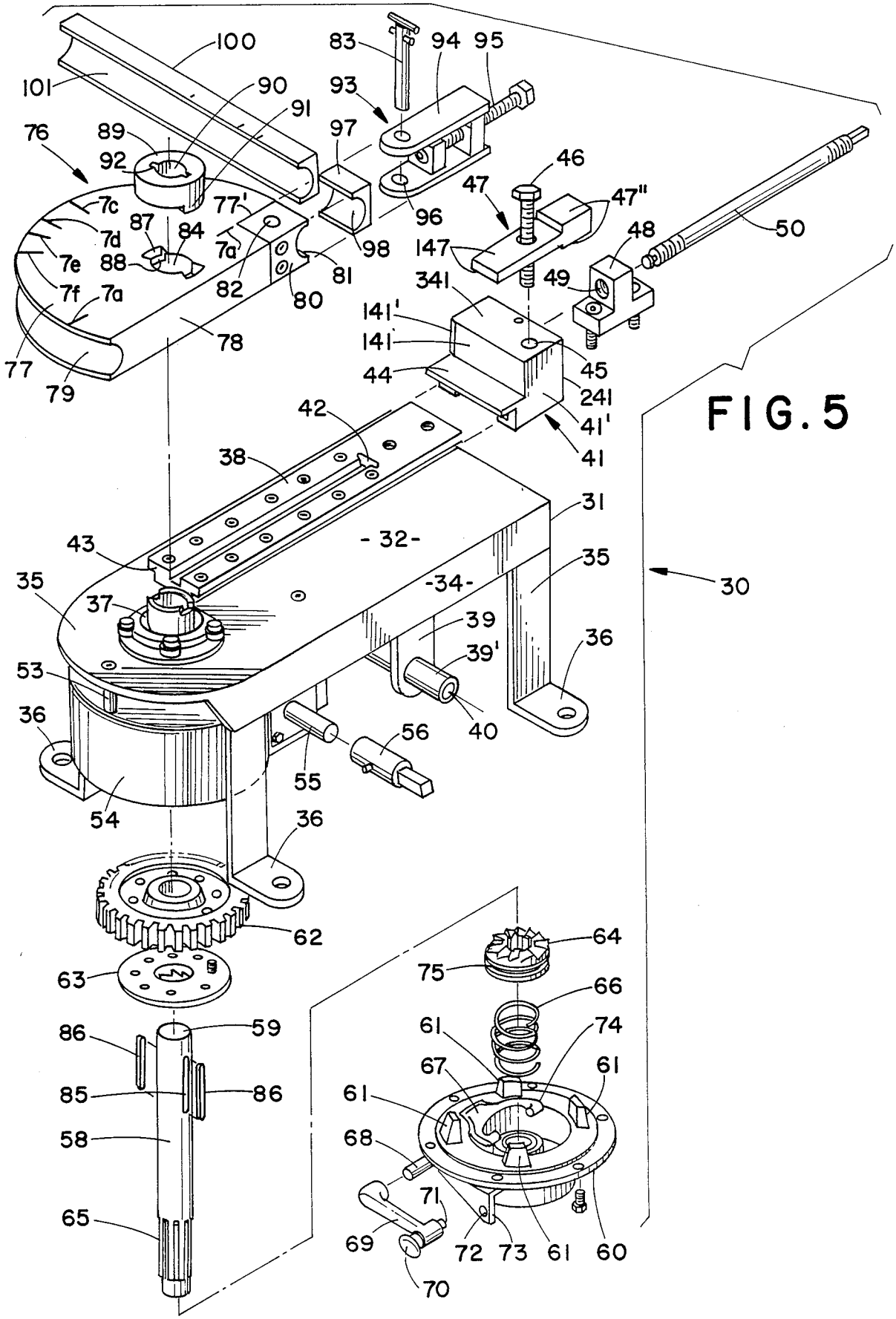
FIG. 5 is an exploded perspective view of the preferred embodiment of the tube bending apparatus of the present invention.

As may be seen from FIGS. 5 through 7, lower casing 60 is provided with a plurality of raised bosses 61 extending upwardly into main casing 54. A worm wheel gear 62 is fitted on output shaft 58 for free rotation thereon. The hub of worm wheel 62 is abutted at its upper side by bushing 111 in main casing 54 which carries the middle of output shaft 58, while the lower flange of worm wheel 62 is abutted by the upper projecting ends of bosses 61. The teeth of worm wheel 62 are in meshed engagement with driving worm 57 of input worm shaft 55, so that worm wheel 62 is rotatably driven by the rotation of input worm shaft 55. However, because driven worm wheel 62 is freely rotatable on output shaft 58, rotation of worm wheel 62 does not directly impart any rotation to output shaft 58.

An axially fixed clutch gear 63 having teeth on only one of its side faces is bolted to a circular recess in the lower flange of the worm wheel 62. The teeth of fixed clutch gear 63 are formed with a 5 degree back cut and face downwardly toward lower casing 60. A sliding clutch gear 64 is slidably spline-fitted onto a lower splined portion 65 of output shaft 58 for rotation therewith. The teeth of sliding clutch gear 64 face upwardly and are also formed with a 5 degree back cut in complementary fashion to the teeth of fixed clutch gear 63. The 5 degree back cut of the teeth of both fixed clutch gear 63 and sliding clutch gear 64 ensures positive meshing engagement and prevents "pull out" of the gears. Sliding clutch gear 64 is biased upwardly into meshing engagement with fixed clutch gear 63 by a spring 66.

A clutch yoke 67 is mounted on one end of a shaft 68 in gearbox lower casing 60 as shown in FIGS. 5 and 6. A clutch handle 69 is provided on the other end of shaft 68 to permit clutch yoke 67 to be raised and lowered. The clutch handle 69 has a slidable knob 70 provided with a detent pin 71 which is able to engage a hole 72 provided in a bracket 73 attached to the gearbox lower casing 60, for locking the clutch yoke 67 in a lowered position. Fork 74 on the clutch yoke 67 loosely rides in a groove 75 in the periphery of sliding clutch gear 64, thus permitting sliding clutch gear 64 to be lowered away from fixed clutch gear 63 when the clutch handle 69 is manually lowered. In this way, when clutch handle 69 is in its raised position, then the force of spring 66 urges sliding gear 64 upwards into meshing engagement with fixed gear 63, and conversely, by manually lowering clutch handle 69 against the force of spring 66, then sliding gear 64 can be disengaged from fixed gear 63. Locking the clutch handle 69 in its down position thus disengages sliding gear 64 from fixed gear 63 and permits output shaft 58 to rotate freely, while releasing clutch handle 69 into its raised position engages sliding gear 64 with fixed gear 63 causing output shaft 58 to be driven by input worm shaft 55 via driving worm 57, worm wheel 62, fixed clutch gear 63 and sliding clutch gear 64. Typically, a 30:1 drive ratio may be provided between input worm shaft 55 and output shaft 58.

One-way drive assembly 52 as described above incorporates several components from commercially available tow truck winches. However, the commercially available gearbox models permit driving the output shaft (winch drum) in either direction of rotation, which is of course desirable for winch operation but which is quite undesirable in a tube bending apparatus because of the risk of wrinkling, crimping or buckling the tubing if the rotation of the radius block is reversed during the bending operation. Further, the resistance encountered in trying to unbend a tube which could occur if output shaft rotation were reversed during bending might also cause structural damage to the driveline components. Therefore, significant modifications to the commercial gearboxes are required to provide a one-way drive assembly suitable for a tube bending apparatus.

In particular, the present invention's provision of fixed clutch gear 63, sliding clutch gear 64 and spring 66 makes possible a positive one-way gearbox drive means. In the case that the rotation of the input worm shaft 55 is reversed while sliding clutch gear 64 is engaged with fixed clutch gear 63 and the output shaft is loaded, then a ratcheting action will occur due to the face cut teeth on fixed clutch gear 63 and sliding clutch gear 64. In this ratcheting action, the teeth of sliding gear 64 will be forced to ride up the teeth of fixed gear 63, forcing sliding gear 64 against the urging force exerted by spring 66 and away from and out of engagement with fixed gear 63. In this way, only one-directional rotation of output shaft 58 in the desired bending direction is possible when clutch handle 69 is in its raised position and sliding gear 64 is engaged with fixed gear 63.

Referring now particularly to FIGS. 5 and 7, there is indicated generally at 76 the radius block assembly of a first embodiment of the tube bending apparatus of the present invention. Radius block assembly 76 includes a radius block 77 having the general shape of a short cylindrical segment exceeding 180 degrees in arcuate periphery with a straight edge face 78. Radius block 77 has formed therein a curved peripheral semicircular concavity 79 extending over more than 180 degrees therearound at a constant radius to provide a die surface 79. One corner of radius block 77 is provided with a square notch 77' aligned with the centerline of the curved concavity of die surface 79 thereof to accommodate a stationary clamp jaw 80 which is bolted to the radius block. Stationary clamp jaw 80 is formed with a straight semicircular concavity 81 which conforms in cross-section and is aligned with the curved concavity of the radius block's die surface 79. Stationary clamp jaw 80 is also formed with a hole 82 into which a pin 83 is insertable.

Radius block 77 is provided at the centerline of curvature of die surface 79 with a center hole 84 for permitting radius block 77 to be fitted over the upper end 59 of output shaft 58. In order to facilitate proper alignment of radius block assembly 76 in its starting position when mounted on shaft 58 and for gauging the degree of bends, radially extending degree index marks *7a*, *7b* etc. may be provided at angular intervals on the top surface of radius block 77. It should be noted that the 0° index mark *7a* aligns with notch 77' in radius block 77 in which stationary clamp jaw 80 is mounted.

As may be clearly seen from FIG. 5, output shaft 58 is provided with a pair of keyways 85 near upper end 59 to accommodate therein a pair of keys 86. Center hole 84 in radius block 77 is provided with a pair of outwardly extending diametrically opposed dovetailed recesses 87 formed therein opening upwardly, and also has formed therein a pair of keyways 88 corresponding to keyways 85 in output shaft 58. In this way, radius block assembly 76 may be keyed to the upper end 59 of output shaft 58 for rotation therewith.

For ease of manufacture and to reduce weight, radius block 77 may preferably be fabricated of aluminum alloy, while for reasons of strength stationary clamp jaw 80 may preferably be fabricated of steel. However, due to the drive torque developed at output shaft 58 during bending, there is a danger that the keyways 88 in radius block 77 may be stripped out by keys 86 under conditions of heavy loading of radius block 77 because of the comparative softness of the aluminum alloy from which radius block 77 is preferably fabricated.

Therefore, a steel hub collar 89 is provided to absorb the torque load from output shaft 58 and to distribute this torque load to radius block assembly 76. Hub collar 89 is formed with a center hole 90 for insertion onto end 59 of output shaft 58 on top of radius block 77. A pair of downwardly extending dovetail projections 91 are formed on the hub collar for engagement in dovetailed recesses 87 of radius block 77. Further, center hole 90 and projections 91 of hub collar 89 have keyways 92 formed therein for engagement with keys 86 so that hub collar 89 can be keyed for rotation with output shaft 58. In this way, the driving torque of output shaft 58 is transmitted via keys 86 to both radius block 77 and hub collar 89, with hub collar 89 transmitting torque to radius block 77 via the projections 91 and recesses 87. Keys 86 preferably are selected to have appropriate shear properties to provide a safety factor, so that excessive torque which might otherwise damage the tube being bent or the apparatus will instead cause shearing of keys 86, thus preventing damage to the other components. Generally, hub collar 89 is not required when bending tubing under 1½ O.D.

A tube clamp assembly is indicated generally at 93. Tube clamp assembly 93 includes a "C-shaped" clamp frame 94 through the closed end of which is threadedly provided a clamp screw 95. A hole 96 is provided through each of the open ends of clamp frame 94 for receiving the pin 83. Tube clamp assembly 93 further includes a steel movable clamp jaw 97 which is slidable in the clamp frame 94. The movable clamp jaw 97 has formed therein a straight semicircular concavity 98 having a cross-section matching that of concavity 81 formed in stationary clamp jaw 80 of radius block assembly 76. The open ends of clamp frame 94 may be slid over stationary clamp jaw 80 to align holes 96 in clamp frame 94 with hole 82 through stationary clamp jaw 80, and then the pin 83 may be inserted through the aligned holes 96 and 82 to secure clamp frame 94 to radius block assembly 76. Tube clamp assembly 93 is used to clamp a straight length of tubing 99 (FIG. 1) to radius block assembly 76 in a manner which will be more fully described below.

The slide block means of the first embodiment of the present invention is indicated at 100. Slide block 100 is formed from a tool steel bar and has at least one straight semicircular concavity 101 formed therein along its length conforming in cross-section with concavity 81 in stationary clamp jaw 80 and concavity 98 in movable clamp jaw 97. Slide block 100 is slidable along side face 141 and shoulder 44 of vise block 41. When placed on shoulder 44 and against side face 141 of vise block 41, slide block 100 can be restrained from vertical movement by fastening slide block retainer plate 47 down onto the top 341 of vise block 41 with screw 46 to retain slide block 100 under retainer plate 47.

The operation of the first embodiment of the present tube bending apparatus will now be described. FIGS. 1 through 4 show the apparatus in a condition ready for commencement of a bending operation on a straight length of tubing 99. In preparation for bending, clutch handle 69 is first put into its lower locked position to disengage gears 63 and 64 and permit freewheeling of output shaft 58. Radius block assembly 76 is then mounted on the upper end 59 of output shaft 58, with keyways 88 in radius block 77 engaging keys 86. Hub collar 89 is placed on end 59 of shaft 58 over radius block assembly 76 with projections 91 of hub collar 89 engaging recesses 87 in radius block 77 to interlock radius block assembly 76 with hub collar 89. Radius block assembly 76 is then rotated so that its straight edge face 78 is facing the front side rail 34 in the direction of square drive fitting 56 on the front end of input worm shaft 55, and the 0 degree index mark 7*a* on radius block 77 is aligned with the front face 41' of vise block 41 of the slide block retaining means in order to position radius block assembly 76 in the 0 degree starting position. Next, clutch handle 69 is moved upward into its drive position, in order to engage gears 63 and 64. Tube clamp assembly 93 is then attached to radius block assembly 76 by sliding the open end of clamp frame 94 over stationary clamp jaw 80, aligning holes 96 in clamp frame 94 with hole 82 in stationary clamp jaw 80, and inserting pin 83 therethrough. Movable clamp jaw 97 is then positioned in clamp frame 94 with concavity 98 in movable clamp jaw 97 facing concavity 81 in stationary clamp jaw 80.

The end of a straight length of tubing 99 to be bent is then slid into position between stationary clamp jaw 80 of radius block assembly 76 and movable clamp jaw 97 of tube clamp assembly 93 so that tubing 99 is positioned between the opposing concavities 81 and 98. Slide block 100 is then slid onto shoulder 44 and against side face 141 of the vise block 41 to lie alongside tubing 99, and then slide block 100 is positioned so that its forward end is aligned with the front face 41' of vise block 41 to properly locate slide block 100 in its 0 degree starting position. Surface 141' is canted 5° away from the plane of surface 141 to avoid the scraping of lubricating grease from rear surface 100' of slide block 100. Next, slide block retainer plate 47 is fastened down onto vise block 41 with screw 46 to slidably retain slide block 100 under retainer plate 47 on vise block 41. Then, by turning vise screw 50, vise block 41 with slide block 100 retained slidably thereon is moved along vise rail 38 to position slide block 100 in relation to tubing 99 until the concavity 101 in slide block 100 is snug against tubing 99. Care must be taken not to overtighten vise screw 50, in order to permit sliding of slide block 100 as tubing 99 advances during the bending operation. The mutually contacting surfaces of slide block 100, side face 141, shoulder 44 and retainer plate 47 are preferably coated with a suitable grease to facilitate sliding of slide block 100 during bending.

Next, clamp screw 95 is tightened to clamp tubing 99 to radius block assembly 76 between stationary clamp jaw 80 and movable clamp jaw 97, so that tubing 99 is securely clamped by concavities 81 and 98, and in this way the apparatus is prepared for commencing the bending operation.

Figure 3:
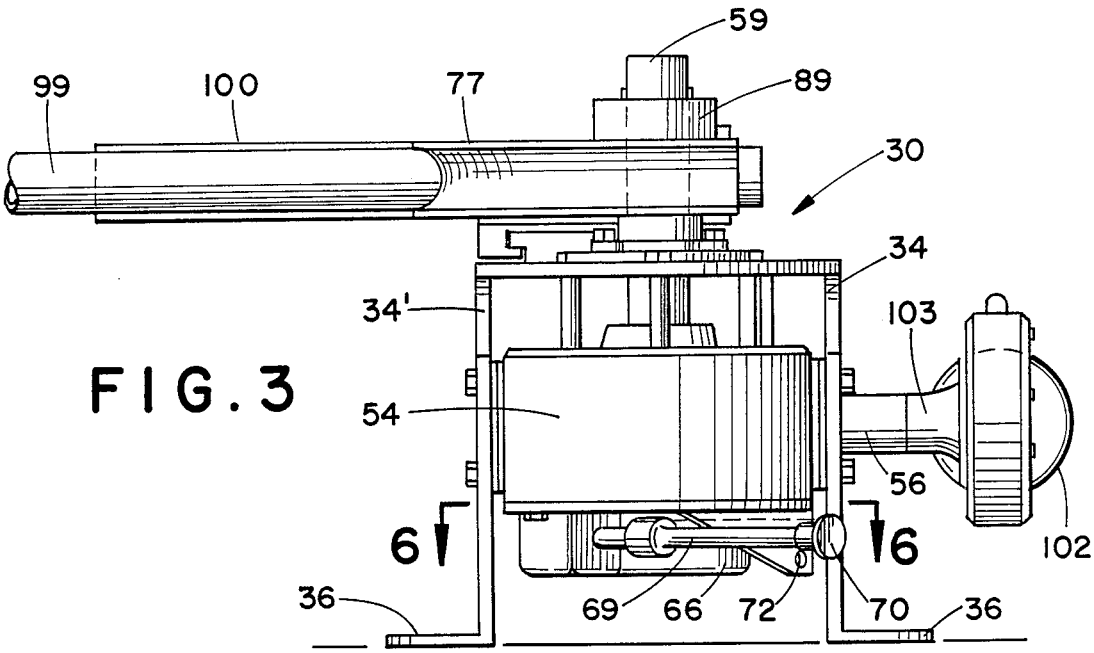
FIG. 3 is a left elevation view of the preferred embodiment of the tube bending apparatus of the present invention as shown in FIG. 1.
Figure 4:
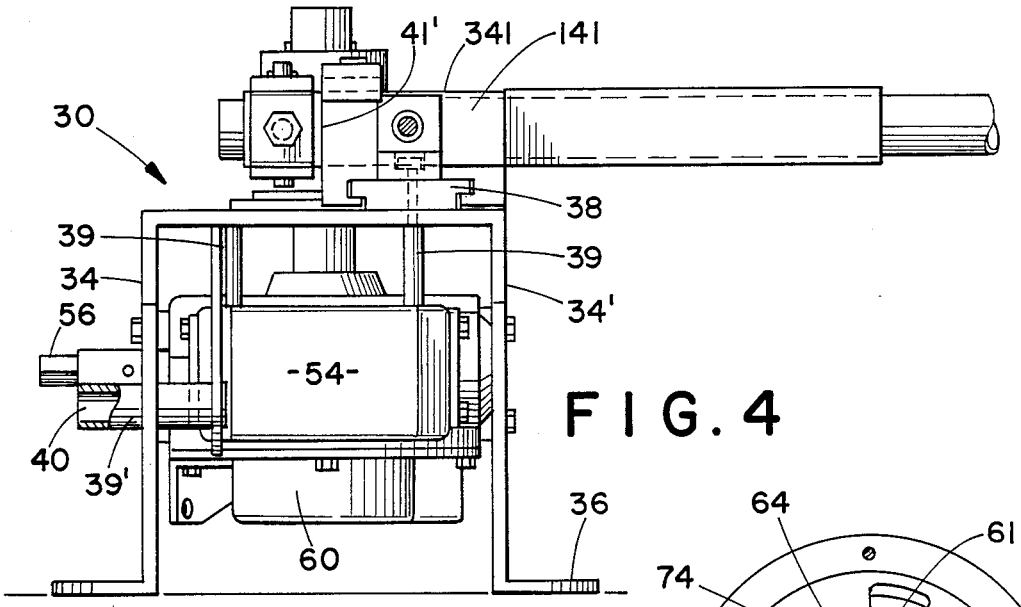
FIG. 4 is a right elevation view of the preferred embodiment of the tube bending apparatus of the present invention as shown in FIG. 2.

As noted above, the driving force for rotating radius block assembly 76 can be supplied by either portable electrically powered drive means or by manual drive means. Referring now to FIGS. 1, 3 and 10, there is shown a portable electric-motor-driven power drive 102 which is the preferred power drive means for supplying driving force to the present apparatus. A suitable commercially available device which provides high torque and may be used as power drive 102 is the RIDGID Model 700 heavy-duty portable power drive manufactured by the Ridge Tool Company of Elyria, Ohio. The RIDGID Model 700 power drive is widely used in many trades for threading pipe, conduit and rod stock, and for powering hoists, winches, etc., as well as for operating large valves. Thus, such devices are already in wide use in the many trades to which the present tube bending apparatus is directed. Various adapters are available for the RIDGID Model 700 power drive. For coupling the output of the Model 700 power drive to the square drive fitting 56 on the front end of input worm shaft 55, the Model 700 power drive is preferably equipped with a RIDGID No. 774 square drive adapter indicated at 103. Power drive 102 is also preferably equipped with a RIDGID No. E-883 torque arm or alternately a six inch length of pipe to provide a torque arm 104 which is insertable into recess 40 in the front of table means 31. The rotational drive direction of the RIDGID Model 700 power drive may be easily reversed by manipulating the power switch 105 thereon, however, there is no risk of damage to the tube bending apparatus or the tube being bent due to inadvertent reverse driving of power drive 102 during the bending operation because of the provision of one-way drive means 63, 64 etc. in the present apparatus. In fact, the reversibility of the Model 700 power drive's driving direction is advantageously utilized after a tubing bend has been completed, as will be explained below.

Figure 11:
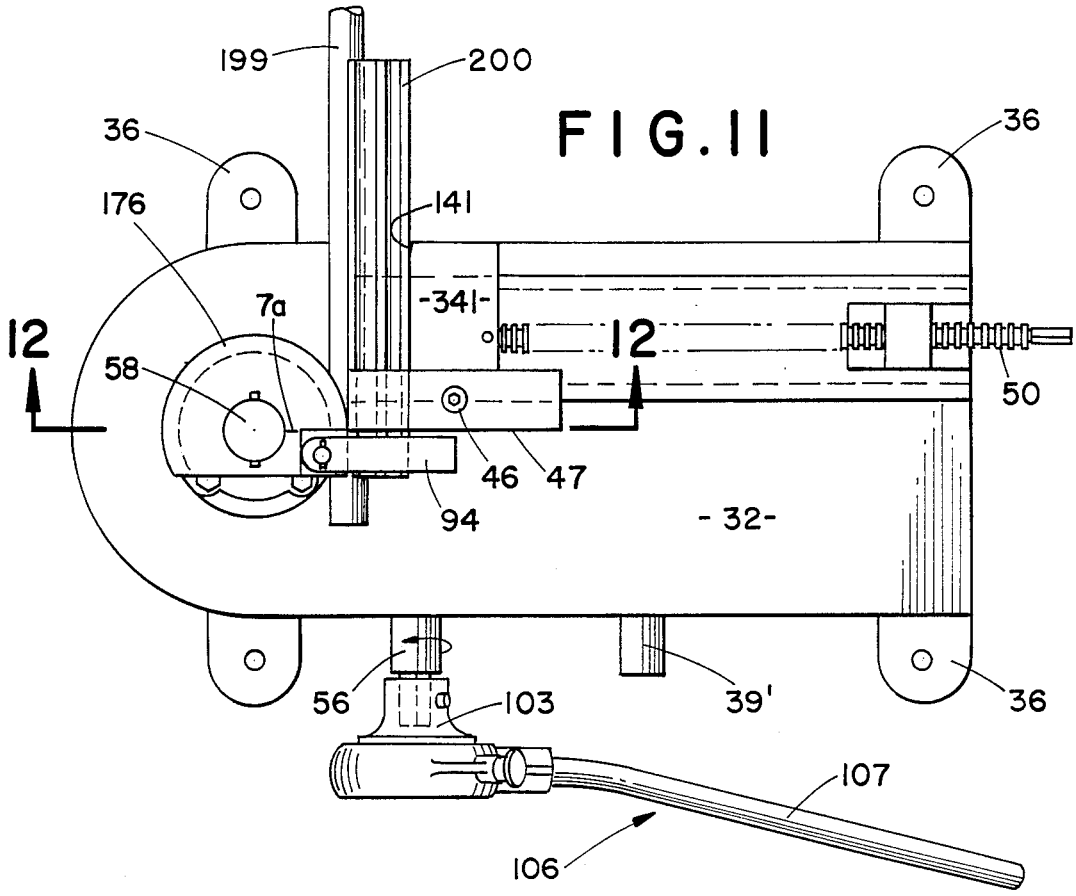
FIG. 11 is a top plan view showing the preferred embodiment of the tube bending apparatus of the present invention being manually operated and ready for commencing a bending operation.

Referring now to FIGS. 10, 11 and 16, there is shown a preferred manual drive means indicated at 106 which may suitably be a widely used RIDGID Model 12R ratchet handle designated at 107, equipped with a RIDGID No. 774 square drive adapter 103 for coupling to square drive fitting 56. The Model 12R ratchet handle 107 can be set for driving in either rotational direction and thus also advantageously finds utility when used for manual driving of the present apparatus, as will also be explained below.

Operation of the tube bending apparatus of the present invention for forming a tubing bend will now be explained with reference made to FIGS. 10 and 11. As shown in FIGS. 1, 3 and 10, for powered bending operation the power drive means 102 is attached to the apparatus 30 by engaging square drive adapter 103 over square drive fitting 56 on the front end of input worm shaft 55, at the same time inserting torque tube 104 into recess 40 in the front of table means 31. With clutch handle 69 in its raised position for positive driving of one-way drive assembly 52, and with a length of tubing 99 clamped to radius block assembly 76 as shown in FIGS. 1 through 4, then switch 105 on power drive 102 is operated to drive input worm shaft in a clockwise direction which in turn causes output shaft 58 and radius block assembly 76 mounted thereon to be driven in a clockwise direction, as shown by the arrows in FIG. 10. As radius-block assembly 76 is rotated, the tubing 99, in which a bend is being formed, is drawn by its portion clamped to radius-block assembly 76, causing the inside portion of tubing 99 following the clamped portion thereof to engage the die surface 79 of radius block 77. At the same time, the outside portion of tubing 99 which had been engaged by concavity 101 of slide block 100 is drawn forwardly toward radius-block assembly 76 and away from engagement in concavity 101 of slide block 100. This causes slide block 100 to be drawn successively forward through vise block 41 in tangential relation to the forward curved motion of tubing 99 upon die surface 79 of rotating radius block assembly 76. Bending occurs in the region where the straight portion of tubing 99 first engages the die surface 79 of radius block 77, which corresponds to the region of tubing 99 aligned with front face 41' of vise block 41 and the centerline of rotation of radius block assembly 76. Because tubing 99 is engaged at the region of bending between the die surface 79 on its inside portion and the slide block concavity 101 on its outside portion, the round tube cross-section is maintained during forming of the bend due to the extrusion effect provided by engagement of the tube within the surrounding concave surfaces as the tube is pulled forward.

Power drive 102 is operated to drive rotation of radius block assembly 76 until the desired degree of bend has been achieved, that is , until the desired degree of bend of bent tubing 99' is indicated by alignment of the appropriate index mark on radius block 77 (such as 45 degree mark *7c* in FIG. 10) with the front face 41' of vise block 41. Then, depending on the factors of tube diameter, wall thickness and material, power drive 102 is operated to further rotate radius block assembly 76 to produce an "overbend" in tubing 99' of from 2 to 10 degrees in order to compensate for the "spring back" action of the tube after removal from the radius block means. When bending thin wall or small size tubing which is more easily bent, it may be preferable to detach power drive 102 after achieving a desired degree of bend, and to use the manual drive means 106 for overbending to avoid the possibility of excessive overbending. Furthermore, for lighter duty bending operations, power drive 102 may not be required at all, and driving may be done manually with manual drive means 106. Still further, because a 30:1 or greater drive ratio is preferably used, manual driving may be sufficient for a wide range of bending operations with the present apparatus, depending on tube size, wall thickness and material.

For manual driving, it is only necessary to attach manual drive means 106 to square drive fitting 56 in place of power drive 102. Bending is performed in the same manner as described above. When forming long bends, care must be taken to assure that the slide block 100 does not move forwardly out of engagement with shoulder 44 of vise block 41. In cases of forming long bends such as 180 degree bends, it may become necessary to reset slide block 100 by loosening vise screw 50 and then sliding slide block 100 back into its starting position and retightening vise screw 50 to snug slide block 100 against the straight tube section before resuming the bending operation. After overbending tubing 99 the necessary number of degrees, it is necessary, before removing the bent tube from the apparatus, to relieve the strain on the tube. If power drive 102 is being used for the powered drive, then relieving strain on the tube can be quickly achieved by operating switch 105 to reverse the driving direction of power drive 102. Thus reversing the drive direction of input worm shaft 55. The initial reverse driving will remove any strain in the tubing 99'. However, if excessive reverse drive is applied, this will cause ratcheting of gears 63 and 64 in one-way drive assembly, and no reverse torque will be transmitted to output shaft 58.

Alternately, clutch handle 69 can be lowered and locked into its drive disengaging position after overbending has been completed to relieve strain on the tube 99'. In any case, after strain relieving, the clutch is disengaged, if not already in that condition, and the tube 99' is unclamped by loosening clamp screw 95, removing pin 83 and separating clamp frame 94 from stationary clamp jaw 80. Screw 46 is then loosened to loosen slide block retainer plate 47. Vise block 41 is backed off with vise screw 50 and slide block 100 is removed.

This done, the apparatus is in condition for removing or repositioning the tube 99' for another bend. Before another bending operation can be performed, the radius block assembly 76 must be rotated back to its 0 degree starting position. Then the above described operations may be performed again to form additional bends in the remaining straight portions of tube 99', or to form bends in another straight length of tubing 99.

The present apparatus is advantageously provided with means for gauging the center to center dimensions (as measured along the axis of tube 99) of finished bends prior to performing the bending operation to facilitate the accurate laying out of 45 degree, 90 degree and reverse bends. As shown in FIG. 1, slide block 100 is provided with "gain" marks along the top surface thereof labelled "45", "90" and "R". These gain marks indicate the amount of gain in the center to center dimension of a tube bend at a particular radius in 45 degree and 90 degree forward and reverse bends. The location of the gain mark for a 45 degree bend is derived as follows:

$$\text{Gain} = \left[ \frac{1}{\cos 45 \text{ degrees}} (r) \right] - r$$

where r is the bend radius. For example, the location of the "45" gain mark for an 8 inch radius bend determined according to equation (1) would be:

$$\text{Gain} = \left[ \frac{1}{0.70770678} (8) \right] - 8$$

$$\text{Gain} = 11.313708 - 8$$

$$\text{Gain} = 3.3137085 = \text{approx. } 3.314 \text{ in.}$$

Accordingly, the "45" gain mark is made on the slide block at a distance of 3.314 inches from the starting end thereof. That is, from the end of the slide block positioned at the 0 degree position aligned with front face 41' of the vise block 41 at the beginning of the bending operation. The location of the "90" gain mark for an 8 inch radius bend is derived as follows: Gain=r.

Thus, for an 8 inch bend radius the "90" gain mark is made on the slide block at a distance of 8 inches in from the starting end thereof.

The "R" gain mark for a reverse bend is made at a distance of 3.314 inches back from the "90" gain mark, that is, at a distance of 4.686 inches from the starting end of the slide block. The distance between the "R" and "90" gain marks is the gain for a 90 degree bend.

The method for laying out bends will now be described. The "45", "90" and "R" gain marks on the slide block correspond to the center to center dimensions (as measured along the axis of the tube) of finished bends. A tube to be bent is first marked for center to center dimension measurement. If the end of the tube that the measurement is to be taken from is on the clamp side , then the tube mark is placed on the "90" gain mark for a 90 degree bend or at the "45" gain mark for a 45 degree bend. If the tube end that the measurement is taken from is on the slide block side of the bender, then the tube mark is placed on the "R" gain mark for a 90 degree bend or on the "45" gain mark for a 45 degree bend. In this way, accurate finished center to center dimensions can be ensured.

Figure 13:
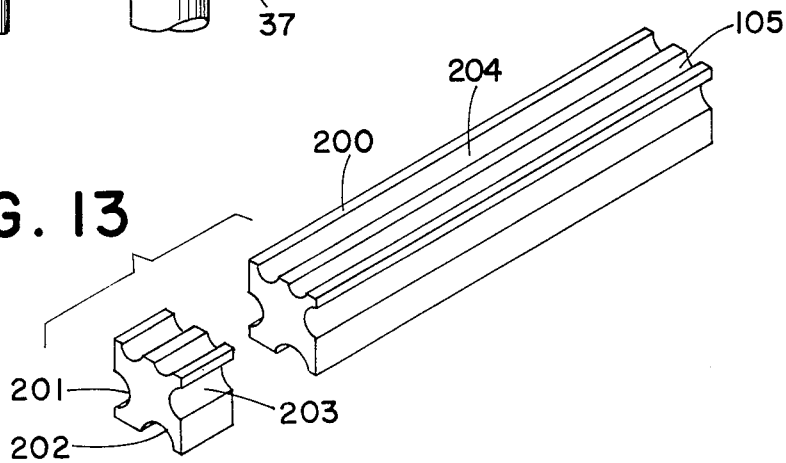
FIG. 13 is a perspective view showing a slide block means of the preferred embodiment of the present invention.

The present apparatus can accommodate a number of different tube sizes, and can form bends of different radii by the provision of interchangeable radius block and slide block means. Referring now to FIGS. 11, 12 and 13, there is shown a radius block assembly 176 having a small cross-section curved peripheral concave semicircular die surface 179 and intended for forming minimum radius bends in small diameter tubing 199. Because less torque is required for forming bends in small diameter tubing, radius block assembly 176 does not require the use of a hub collar and is keyed for rotation with output shaft 58. Drive in this case may be supplied manually with manual drive means 106. A slide block 200 is provided with a plurality of straight semicircular concavities 201–205 formed in the sides thereof, each of the concavities 201–205 being sized to accommodate a different size tube therein. By positioning slide block 200 on vise block 41 with the appropriate sized one of concavities 201–205 facing the tube, a variety of tube sizes can be accommodated by a single slide block means. Each of the concavities 201–205 is located at the appropriate height in a side of slide block 200 so as to match the height of the concave die surface in a corresponding radius block means. Slide block 200 is formed from a bar of tool steel. The sides of slide block 200 differ in height from those of slide block 100. This height difference is accommodated by the different heights of the top and bottom retaining surfaces 147, 247 and 347 of slide block retainer plate 47 as shown clearly in FIG. 12. By appropriately reversing the ends of retainer plate 47 and by turning retainer plate 47 over, as previously described, slide blocks of three different heights can be accommodated.

FIGS. 14A, 14B, 15A and 15B show additional interchangeable radius block assemblies 276 and 376 which are similar to radius block assembly 176 but which are intended to accommodate different tube sizes. Thus, the radii of curvature and cross-sectional sizes of semicircular concave die surfaces 279 and 379 formed therein are different from die surfaces 79 and 179.

Radius block assemblies 276 and 376 are respectively provided with stationary clamp jaws 280 and 380 having respective straight semicircular concavities 281, 381 and with holes 282, 382 for receiving pin 83. Respective center mounting holes 284, 384 are provided for mounting radius block assemblies 276, 376 on output shaft 58. Stationary clamp jaws 280, 380 are formed to have the same height as stationary clamp jaw 80 of radius block assembly 76 in order to accommodate clamp frame 94. Interchangeable movable clamp jaws with appropriately sized concavities thus permit the tube clamping means of the present apparatus to accommodate various tube diameters.

By virtue of the above described design, the tube bending apparatus of the present invention advantageously provides capabilities exceeding those of conventional tube benders while being of simple construction. The present apparatus is capable of forming bends in 0.188 inch wall stainless steel tubing and in 0.220 inch wall steel tubing. A particularly advantageous application of the present apparatus is in the bending of tubing for high pressure gas service. A recommended minimum wall thickness for 2 inch diameter high pressure gas service fittings is 0.167 inch which permits desirable coining of the tube surface. The above described Lakeland Products Model HB832A bender is incapable of forming bends in 0.220 inch wall 2 inch diameter steel tubing. This conventional bender has a limited maximum bending capability of 0.120 inch wall thickness tubing. This limitation to 0.120 inch maximum wall thickness tubing significantly and undesirably limits the maximum working pressure of the tubing, especially in high temperature service. In contrast, the capabilities of the present apparatus of forming bends in 0.220 inch wall steel tubing and 0.188 inch wall stainless steel tubing provides for significantly increased working pressures in high pressure gas service. The present apparatus thus advantageously overcomes limitations present in conventional tube benders and provides significant improvements thereover.

Referring now to FIGS. 17 through 21, a second embodiment of the present apparatus will be described.

FIG. 21 illustrates a length of tubing 299 formed with a radiused 360 degree overlapping bend. Such a bend is formed by bending a tube around a fixed radius and in two directions, horizontally and vertically, simultaneously, in distinction to simpler flat 90 degree and 180 degree bends in which a tube is bent around a fixed radius in only one direction. Whereas a flat bend lies in a plane, an overlapping bend describes a cylinder. Such overlapping bends are used in the fabrication of steam gauge "syphon tubes" from steel and brass tubing. Typically, syphon tubes are made in quarter inch iron pipe size, and in 180 degree styles with the straight tube legs running at 180 degrees to each other as in FIG. 21, as well as in 90 degree styles with the straight tube legs crossing at a right angle.

FIGS. 17 through 20 illustrate the radius block and slide block means of a second embodiment of the present tube bending apparatus which differ from the those of the first embodiment described above, while FIG. 21 illustrates a bend performed with the apparatus of the second embodiment. Particularly, the second embodiment includes a cylindrical radius block 477 of aluminum having a center hole 484 provided with keyways 488 by which radius block means 477 can be mounted on upper end 59 of output shaft 58 for keyed rotation therewith.

In the top of radius block 477 there is formed a 90 degree sectoral notch opening into center hole 484. Into this notch there is mounted a clamp member 480 of steel having a generally right triangular shape the base of which is formed with a concave radius to conform with center hole 484 as may be seen in FIGS. 17 and 20. Clamp member 480 has sides that meet at a right angle forming an apex of a right triangle and is connected to radius block 477 in the same manner that member 80 is connected to member 77; however, the clamping members 80 and 480 could be unitarily formed with their respective radius block members if desired. These sides extend tangentially to the cylindrical radius block 477. Along one side of clamp member 480 there is formed a straight semicircular section concavity 481 which also extends in a tangential direction to radius block 477 and which serves the same purpose as concavity 81 of stationary clamp jaw 80 of the first embodiment. The axis of concavity 481 is inclined downwardly from the apex of clamp member 480.

A semicircular section radiused concave die surface 479 is formed in the periphery of radius block 477. Die surface 479 extends from concavity 481 of clamp member 480 in a continuous downward direction around the periphery of radius block 477 in a spiral helix over an angular radial path of at least 360 degrees. In order to accommodate overbending, the angular radial sweep of die surface 479 around radius block 477 may exceed 360 degrees by an additional 2–10 degrees.

For clamping a tube to radius block means 477, there is provided a tube clamping means 493 which includes an L-shaped clamp frame 494. Clamp frame 494 may be secured to the clamp member 480 of radius block means 477 by means of a screw 483 accommodated in a hole in the end of the long top leg of clamp frame 494. Screw 483 can be threadedly secured in a threaded hole 482 provided in the top of clamp member 480 for fastening clamp frame 494 thereto. A clamp screw 495 is threaded through the short leg of clamp frame 494. Thus, a length of tubing 499 can be clamped to radius block means 476 by inserting the tube into the concavity 481 and then advancing clamp screw 495 to securely clamp the tube therebetween. In order to accommodate the downward movement of the tube during the bending operation, a slide block 400 of tool steel having a truncated wedge shape with a high end 405, a low end 406 and an inclined top surface 407 therebetween is provided with a straight semicircular section concavity 401 formed in a side face thereof. The axis of concavity is inclined downwardly from end 405 toward end 406 to conform with the inclination of concavity 481 of clamp member 480 and die surface 479 of radius block assembly 476. The length of slide block 400 is made sufficient to accommodate the length of the bend to be formed, and corresponds to the circumferential length of die surface 479. Slide block 400 is slidable along shoulder 44 of vise block 41, however, because of the movement of the tube during bending, slide block 400 will be urged down onto shoulder 44, making use of the slide block retainer plate 47 unnecessary in this embodiment.

The operation of the second embodiment is similar to that of the first embodiment. The radius block assembly 476 is positioned in its 0 degree starting position and a length of tubing 499 is clamped to clamp member 480 with tube clamping means 493 as already described. Because the clamped tube inclines downwardly and rearwardly on the radius block assembly 476, vise block 41 must be backed away from tube 499 sufficiently to provide clearance for slide block 400. Then, slide block 400 must be positioned in its 0 degree starting position on shoulder 44 of vise block 41 with end 401' of slide block 400 aligned with front face 41' of vise block 41. Vise block 41 is then advanced with vise screw 50 to bring slide block 400 snug against tube 499 with tube 499 snugly engaged by concavity 401. In this state the apparatus of the second embodiment is as shown in FIGS. 17 and 18.

The bending operation for the second embodiment proceeds in the same manner as described above with regard to the first embodiment, by engaging one-way drive 52 and applying either powered or manual drive means 102, 106 to drive the input worm shaft 55 and provide driving of output shaft 58 to rotate radius block assembly 476. Bending is continued until the desired degree of bend is reached. Slight overbending is then performed by further rotation to compensate for spring back, and then reverse drive is applied to relieve strain. One-way drive 52 is disengaged and the bent tubing is released by backing off vise block 41 to disengage slide block 400 from the tube, then unclamping the tube from radius block assembly 476. To facilitate removal of the bent tube, the radius block assembly 476 can be dismounted from output shaft 58, and the tube may then be unwound from die surface 479 of radius block assembly 476. Alternately, the free ends of the tube may be grasped and spread slightly to open the bent tube portion sufficiently to allow removal of the tube from radius block assembly 476.

The position of tube 499 and radius block assembly 476 with tube clamping means 493 secured thereto is shown after 180 degrees of bending by phantom lines in FIG. 17. Rising bends of up to 360 degrees can be easily formed with the apparatus of the second embodiment of the present invention. Using radius block assembly 476 and slide block 400 as shown in FIGS. 19 and 20, the overlapped 360 degree bend shown in FIG. 21 can be formed to provide a 180 degree style syphon tube.

It will be appreciated that by using a higher radius block means having a longer spiral die surface with a correspondingly greater angular sweep, along with a suitably longer slide block, it would also be possible to form coiled bends with the present apparatus.

It will also be appreciated that many variations, changes and modifications to the present invention are possible without departing from the scope thereof. Accordingly, the scope of the present invention is intended to be limited only by the scope of the appended claims.

We claim:

1. A tube bending apparatus comprising:

table means;

one-way drive means mounted to said table means and including:

input shaft means operatively engaging said drive means;

output shaft means protruding upwardly through said table means;

one-way gearbox means selectively transmitting rotational torque applied in a first driving direction to said output shaft means for rotating said output shaft means in a first driven direction while preventing transmission of rotational torque applied in a second driving direction at said input shaft means to said output shaft means;

radius block means having a centerline and a curved semicircular concave bending die surface formed in the periphery thereof at a fixed radius about said centerline thereof, said radius block means being mountable at the centerline thereof on said output shaft means for rotation therewith;

hub collar means mountable on said output shaft means for rotation therewith, said hub collar means being of higher strength than said radius block means an operatively engaging said radius block means whereby said hub collar means transmits drive torque from said output shaft means to said radius block means;

tube clamping means for clamping a tube to said radius block means;

slide block means having a straight semicircular section concavity formed therein extending axially along one side thereof and conforming in cross-sectional diameter with said concave bending die surface of said radius block means; and, slide block retainer means mounted on said table means for retaining said slide means slidably therein.

2. A tube bending apparatus according to claim 1, wherein said one-way gearbox means comprises:

a first worm gear fixed on said input shaft means for rotation therewith;

a worm wheel rotatable on said output shaft means and in meshed engagement with said first worm gear;

a first clutch gear fixed to said worm wheel and rotatable therewith on said output shaft means;

a second clutch gear carried on said output shaft means for rotation therewith, said second clutch gear being movable along said output shaft means between a first position in which said first and second clutch gears are brought into meshed engagement with one another and a second position in which said first and second clutch gears are spaced apart from and out of meshed engagement with each other;

spring means for urging said second clutch gear toward said first position thereof; and clutch yoke means for selectively moving said second clutch gear between said first and second positions thereof.

3. A tube bending apparatus according to claim 2, wherein opposing faces of said first and second clutch gears are formed with back cut teeth for meshing engagement therebetween in said first driven direction of said output shaft means, and for ratcheting therebetween in a direction opposite to said first driven direction of said output shaft means, whereby when said second clutch gear is in its said first position and said first clutch gear is driven in a direction opposite to said first driven direction of said output shaft means, said second clutch gear will be forced apart form said first clutch gear such that said opposing teeth of said first and second clutch gears are caused to ride over each other without meshing occurring therebetween.

4. A tube bending apparatus according to claim 1, wherein said tube clamping means comprises:

a stationary clamp jaw fixed to said radius block means, said stationary clamp jaw having a straight semicircular section concavity therein contiguous with said concave bending die surface of said radius block means and having an equal cross-sectional diameter thereto;

a clamp frame attachable to said stationary clamp jaw;

a movable clamp jaw slidable in said clamp frame, said movable clamp jaw having a straight semicircular section concavity therein having an equal cross-sectional diameter to said concave bending die surface of said radius block means; and a clamp screw threadedly carried by said clamp frame, for advancing said movable clamp jaw towards said stationary clamp jaw for clamping a tube therebetween.

5. A tube apparatus according to claim 1, wherein said slide block means has a plurality of straight semicircular section concavities of different cross-sectional diameters formed therein axially extending along plural sides thereof, the cross-sectional diameter of each of said concavities in said side block means corresponding to the cross-sectional diameter of a bending die surface of a corresponding one of said plurality of radius block means.

6. A tube bending apparatus according to claim 1, wherein said slide block retainer means comprises:

a vise rail mounted on said table means;

a vise block movable along said vise rail toward and away from said shaft means, said vise block having a shoulder formed in a side face thereof opposing said output shaft means for slidably carrying said slide block means thereon, said vise block further having a front face aligned with a centerline of said output shaft means;

vise screw for advancing and retracting said vise block along said vise rail; and retainer plate means attachable to a top face of said vise block so as to oppose said shoulder thereof in spaced relation thereto for slidably retaining said slide block means in said slide block retainer means between said shoulder of said vise block and said retainer plate means.

7. A tube bending apparatus according to claim 6, wherein said retainer plate means is provided with reversible top and bottom end surfaces having different heights for slidably retaining different heights of said slide block means in said slide block retainer means between said shoulder of said vise block means and said retainer plate means.

8. The tube bending apparatus as defined in claim i further comprising shearing means for limiting excessive torque transmission to said radius block means.

9. A tube bending apparatus comprising:

table means:

drive means mounted to said table means and including:

input shaft means;

output shaft means protruding through said table means; and, gearbox means for selectively transmitting rotational torque from said input shaft means to said output shaft means;

radius block means having a centerline and a generally concave bending die surface formed in the periphery thereof at a fixed radius about said centerline thereof, said radius block means operatively engaging said output shaft means for rotation therewith;

means for clamping a tube to said radius block means;

slide block means having a generally concave surface extending along one side thereof and conforming generally with said generally concave bending die surface of said radius block means; and, means for slidably retaining said slide block means on said table means, said retaining means including a retainer plate provided with reversible top and bottom end surfaces having different heights for slidably retaining different heights of said slide block means on said table means.

* * * * *